US012774506B2

(12) United States Patent
Yang et al.

(10) Patent No.: US 12,774,506 B2
(45) Date of Patent: Oct. 27, 2026

(54) RECOVERY METHOD FOR VALUABLE METALS IN COPPER ANODE SLIME

(71) Applicant: KUNMING UNIVERSITY OF SCIENCE AND TECHNOLOGY, Kunming (CN)

(72) Inventors: Bin Yang, Kunming (CN); Baoqiang Xu, Kunming (CN); Wenlong Jiang, Kunming (CN); Juhai Deng, Kunming (CN); Dachun Liu, Kunming (CN); Yang Tian, Kunming (CN); Yifu Li, Kunming (CN); Lingxin Kong, Kunming (CN); Jia Yang, Kunming (CN)

(73) Assignee: Kunming University of Science and Technology, Kunming (CN)

( * ) Notice: Subject to any disclaimer, the term of this patent is extended or adjusted under 35 U.S.C. 154(b) by 823 days.

(21) Appl. No.: 18/043,943

(22) PCT Filed: Oct. 12, 2022

(86) PCT No.: PCT/CN2022/124771

§ 371 (c)(1),
(2) Date: Mar. 3, 2023

(87) PCT Pub. No.: WO2023/061389

PCT Pub. Date: Apr. 20, 2023

(65) Prior Publication Data

US 2024/0287644 A1 Aug. 29, 2024

(30) Foreign Application Priority Data

Oct. 13, 2021 (CN) ..... 202111191251.9

(51) Int. Cl.
*C25C 1/00* (2006.01)
*C22B 1/06* (2006.01)
(Continued)

(52) U.S. Cl.
CPC ..... *C22B 7/007* (2013.01); *C22B 1/06* (2013.01); *C22B 7/001* (2013.01); *C22B 13/025* (2013.01);
(Continued)

(58) Field of Classification Search
CPC C22B 7/007; C22B 1/06; C22B 7/001; C22B 13/025; C22B 15/0017;
(Continued)

(56) References Cited

U.S. PATENT DOCUMENTS 4,293,332 A 10/1981 Wang et al.
2015/0053572 A1 2/2015 Subbaiah et al.

FOREIGN PATENT DOCUMENTS

CN 101696469 A 4/2010
CN 107217145 A 9/2017
(Continued)

OTHER PUBLICATIONS

CA1179509 to Peters (Year: 1984).*
(Continued)

*Primary Examiner* — Zulmariam Mendez
(74) *Attorney, Agent, or Firm* — SALIWANCHIK, LLOYD & EISENSCHENK

(57) ABSTRACT

Provided is a recovery method for valuable metals in copper anode slime. By using the recovery method of the disclosure, selenium, copper, tellurium, arsenic, lead, bismuth, and precious metals gold and silver in the copper anode slime are recovered. The method adopts two-step vacuum carbothermal reduction to replace reduction smelting of anode slime and stepwise blowing of noble lead in the traditional pyrometallurgy, and avoids the emission of arsenic-containing soot in the traditional process. The recovered gold-rich residue contains almost no base metals such as lead, bismuth, antimony, and arsenic. After subjecting the gold-rich
(Continued)

residue to leaching gold by chlorination and reduction, a gold powder could be obtained therefrom with a lower content of base metals than traditional processes. Therefore, the method greatly reduces the amount of produced slag, shortens the production cycle, and reduces the loss of precious metals in the slag.

20 Claims, 9 Drawing Sheets

(51) Int. Cl.

| | |
|---|---|
| ***C22B 7/00*** | (2006.01) |
| ***C22B 13/02*** | (2006.01) |
| ***C22B 15/00*** | (2006.01) |
| ***C22B 30/04*** | (2006.01) |
| ***C22B 30/06*** | (2006.01) |
| ***C22B 61/00*** | (2006.01) |
| ***C25C 1/20*** | (2006.01) |

(52) U.S. Cl.
CPC ..... *C22B 15/0017* (2013.01); *C22B 15/0056* (2013.01); *C22B 15/0071* (2013.01); *C22B 30/04* (2013.01); *C22B 30/06* (2013.01); *C22B 61/00* (2013.01); *C25C 1/20* (2013.01)

(58) Field of Classification Search
CPC . C22B 15/0056; C22B 15/0071; C22B 30/04; C22B 30/06; C22B 61/00; C25C 1/20
See application file for complete search history.

(56) References Cited

FOREIGN PATENT DOCUMENTS

| | | | |
|---|---|---|---|
| CN | 109371228 | A | 2/2019 |
| CN | 109777962 | A | 5/2019 |
| CN | 110172578 | A | 8/2019 |
| CN | 113846222 | A | 12/2021 |

OTHER PUBLICATIONS

International Search Report dated Dec. 14, 2022 in International Application No. PCT/CN2022/124771.
Office Action dated Aug. 24, 2022 in Chinese Application No. 202111191251.9.
"Section 7. Recovery of white arsenic" in Tin Metallurgy, Yunnan Tin Industry Company, Nov. 30, 1977, pp. 342-343.

* cited by examiner

RECOVERY METHOD FOR VALUABLE METALS IN COPPER ANODE SLIME

CROSS REFERENCE TO RELATED APPLICATIONS

The present application is the U.S. national stage application of International Patent Application No. PCT/CN2022/124771, filed Oct. 12, 2022, which claims the benefit under 35 U.S.C. § 119 of Chinese Patent Application No. 202111191251.9, filed Oct. 13, 2021, each of which is incorporated herein by reference in its entirety.

TECHNICAL FIELD

The present disclosure relates to the technical field of comprehensive treatment of copper anode slime, in particular to a recovery method for valuable metals in copper anode slime.

BACKGROUND

Copper anode slime is gray-black slime formed by impurity metals with high reduction potential, such as bismuth, silver, antimony, and copper, which are not dissolved and adhere to the surface of the residual anode or precipitate at the bottom of the electrolytic cell during the electrolytic refining of blister copper. Copper anode slime has a particle size of about 200 mesh, and a mass of generally about 0.2% to 1.0% of the anode plate. Barium sulfate is introduced into the anode slime as a cathode plate release agent, and most of the barium sulfate may be enriched into the copper anode slime during the copper electrolysis. Due to inclusion of a large amount of gold, silver, copper, lead, bismuth, selenium, tellurium, and platinum group precious metals, the copper anode slime is one of the main raw materials for extracting rare and precious metals.

The key to extracting precious metals and scattered metals is the removal of base metals such as lead and bismuth and the enrichment of precious metals. At present, there are many treatment methods for anode slime, which are generally divided into pyrometallurgy and hydrometallurgy. The more widely used processes include the traditional pyrometallurgy, the Kaldo furnace process, the combined beneficiation-metallurgy process, the full hydrometallurgy, and the semi-hydrometallurgy. In the traditional pyrometallurgy, the removal of base metals such as lead and bismuth is mainly conducted through refining by oxidation in a silver refining furnace. Due to the different affinity with oxygen, base metal elements are oxidized step by step, introduced into the slag or soot, and then separated from the precious metal. However, this process has many procedures, is time-consuming, and produces a large amount of slag and soot.

In the hydrometallurgy, gold is mainly leached by chlorination. Lead dissolves into a liquid phase, and sulfuric acid is added therein to form a lead sulfate precipitate to inhibit lead dissolution. However, lead may still dissolve to a certain extent, depending on the concentration of chloride ions and the acidity of the solution. Under the commonly-used gold leaching conditions, bismuth in the precious metal enriched slag may be partially dissolved. However, since bismuth is easily hydrolyzed, the content of bismuth in the solution is low as long as the pH value of the solution is controlled properly. The anode slime of Guixi Smelter is subjected to sulfation roasting, copper leaching by sulfuric acid, and tellurium separation by sodium hydroxide, and sodium sulfide is added to an obtained tellurium separation solution to precipitate lead; tellurium separation slag is subjected to gold leaching by potassium chlorate, and a bismuth-containing reducing solution is obtained after sulfur dioxide reduction. In the traditional method, valuable metals are replaced by zinc, but there is a phenomenon that the precious metals are not completely reduced (containing gold at 1 mg/L) and metal bismuth is not recovered. Accordingly, bismuth is precipitated in the form of bismuth oxychloride by adjusting the pH value, and then obtained liquid is replaced with a zinc powder after the reaction; gold, platinum, and palladium and other rare and precious metals enter the platinum-palladium concentrate in the form of metals, and the precipitated bismuth oxychloride is washed and filtered to be a raw material for refining bismuth. The hydrometallurgy generally has problems such as complicated procedures, many auxiliary materials, and a large number of waste gases, waste water, and waste residues; although an improved vacuum treatment improves processes in the traditional silver refining furnace, the treatment does not avoid problems in the reduction smelting stage of the noble lead furnace such as long cycle and a large amount of soot.

The combined beneficiation-metallurgy process is mainly composed of the following steps: (1) pretreatment of copper anode slime; (2) flotation; (3) smelting; and (4) treatment of flotation tailings. This combination process could effectively improve the process efficiency, but has a complex process. Especially, the flotation tailings have large silver and gold dispersion and a high content of valuable metals, making it difficult to further process.

SUMMARY

An object of the present disclosure is to provide a recovery method for valuable metals in copper anode slime. By using the recovery method, selenium, copper, tellurium, arsenic, lead, bismuth and precious metals gold and silver in the copper anode slime could be efficiently recovered.

To achieve the above object, the present disclosure provides the following technical solutions.

The present disclosure provides a recovery method for valuable metals in copper anode slime, including the following steps:

- mixing copper anode slime with a concentrated sulfuric acid to obtain a first mixture, and subjecting the first mixture to sulfation roasting to obtain a selenium-containing soot and a calcine;
- subjecting the selenium-containing soot to water absorption, first reduction, and drying in sequence to obtain a crude selenium;
- mixing the calcine with a sulfuric acid solution to obtain a second mixture, and subjecting the second mixture to oxygen stressing and acid leaching to obtain a copper-tellurium-containing leachate and a copper-selenium-tellurium-removed anode slime;
- mixing the copper-tellurium-containing leachate with a copper powder to obtain a third mixture, and subjecting the third mixture to second reduction to obtain a copper-tellurium slag and a copper sulfate solution;
- mixing the copper-selenium-tellurium-removed anode slime with a first charcoal to obtain a fourth mixture, and subjecting the fourth mixture to low-temperature vacuum carbothermal reduction at 400° C. to 550° C. to obtain an arsenic oxide volatile and an arsenic-removed anode slime;
- subjecting the arsenic-removed anode slime to high-temperature vacuum carbothermal reduction at 850° C.

to 1,100° C. to obtain a lead-bismuth mixed volatile and a gold-silver-antimony-rich residue;

subjecting the gold-silver-antimony-rich residue to vacuum distillation to obtain a silver-antimony volatile and a gold-rich residue;

subjecting the silver-antimony volatile to refining by oxidation to obtain an antimony oxide volatile and a crude silver, and subjecting the crude silver to electrolysis to obtain silver; and subjecting the gold-rich residue to leaching gold by chlorination, third reduction, and electrolysis in sequence to obtain gold.

In some embodiments, a mass ratio of the copper anode slime to the concentrated sulfuric acid is in a range of 1:(0.7-1.2); the concentrated sulfuric acid has a mass concentration of 98%; and the sulfation roasting is conducted at 250° C. to 650° C. for 1 h to 4 h.

In some embodiments, the crude selenium has a purity of 85% to 99%.

In some embodiments, during the oxygen stressing and acid leaching, the sulfuric acid solution has an acidity of 100 g/L to 140 g/L; a dosage ratio of the sulfuric acid solution to the calcine is in a range of (5-8) L:1 kg; and the oxygen stressing and acid leaching is conducted at 100° C. to 150° C. and 0.8 MPa to 1.2 MPa for 0.5 h to 4 h.

In some embodiments, the oxygen stressing and acid leaching has a copper removal efficiency of greater than or equal to 98%.

In some embodiments, during the low-temperature vacuum carbothermal reduction, a mass of the first charcoal is 20% to 35% of that of the copper-selenium-tellurium-removed anode slime; and the low-temperature vacuum carbothermal reduction is conducted at a system pressure of 1 Pa to 50 Pa for 2 h to 6 h.

In some embodiments, before the high-temperature vacuum carbothermal reduction, the arsenic-removed anode slime is mixed with a second charcoal; a mass of the second charcoal is 0% to 10% of that of the arsenic-removed anode slime; and the high-temperature vacuum carbothermal reduction is conducted at a system pressure of 1 Pa to 50 Pa for 2 h to 6 h.

In some embodiments, the vacuum distillation is conducted at 1,300° C. to 1,500° C. and a system pressure of 1 Pa to 50 Pa for 6 h to 8 h.

In some embodiments, the refining by oxidation is conducted at 950° C. to 1,100° C. for 3 h to 10 h.

In some embodiments, subjecting the gold-rich residue to leaching gold by chlorination, third reduction, and electrolysis in sequence includes: subjecting the gold-rich residue to the leaching gold by chlorination to obtain a gold-leaching solution; introducing sulfur dioxide into the gold-leaching solution to conduct the third reduction to obtain a gold powder; and subjecting the gold powder to the electrolysis to obtain the gold.

The present disclosure provides a recovery method for valuable metals in copper anode slime. In this recovery method, the copper anode slime is firstly subjected to sulfation roasting to distill selenium; an obtained selenium-containing soot is subjected to water absorption to obtain a crude selenium, and a calcine obtained by the sulfation roasting is subjected to copper-selenium-tellurium removal by oxygen stressing and acid leaching; an obtained leaching solution is subjected to replacement with a copper powder to obtain a copper telluride slag for recovering tellurium, and copper is recovered from an solution obtained by the replacement in a form of copper sulfate. The copper-selenium-tellurium-removed anode slime obtained by oxygen stressing and acid leaching is blended into charcoal and subjected to step-by-step carbothermal reduction. The first step is to conduct low-temperature vacuum carbothermal reduction to convert arsenic into volatile arsenic oxide, thus removing arsenic in the form of arsenic oxide; the second step is to conduct high-temperature vacuum carbothermal reduction, wherein lead, bismuth, and part of silver volatilize into volatiles in the form of compounds or simple substances, while gold, silver, antimony, and barium are enriched in the residue. The residue is then subjected to vacuum distillation to volatilize the silver and antimony, and a silver-antimony antimony volatile is subjected to refining by oxidation to obtain a crude silver, and the crude silver is subjected to refining by electrolysis to obtain silver; the residue obtained from the distillation enriches gold in the copper anode slime, and gold is subjected to leaching gold by chlorination, reduction, and electrolysis to obtain gold.

By using the recovery method according to the present disclosure, selenium, copper, tellurium, arsenic, lead, bismuth and precious metals gold and silver in the copper anode slime are efficiently recovered. The method adopts two-step vacuum carbothermal reduction to replace the reduction smelting of anode slime and the stepwise blowing of noble lead in the traditional pyrometallurgy, and avoids the emission of arsenic-containing soot in the traditional process; the stepwise blowing of noble lead is to separate valuable metals (such as Pb, Bi, Sb, and As) from precious metals in forms of slag and soot by the difference in affinity between valuable metals and oxygen, which has a long recovery time (the stepwise blowing of noble lead requires 61 h to 77 h per furnace, with 3 t of noble lead treated per furnace).

In the present disclosure, the copper-tellurium slag recovered by the recovery method could be used to recover tellurium. The arsenic oxide volatiles produced in the low-temperature vacuum carbothermal reduction stage could be further vacuum-purified to obtain a high-purity arsenic oxide; the volatiles produced in the high-temperature vacuum carbothermal reduction stage contain a large amount of lead, bismuth and part of silver. The volatiles are returned to the lead bottom-blown smelting system, the lead and bismuth are reduced to crude metals, and the silver is supplemented by lead and then enters the crude metals, so as to ensure a removal efficiency of lead and bismuth while avoiding the loss of silver.

In the present disclosure, since the raw materials for refining by oxidation contains only silver, antimony and a small amount of impurities (without lead, bismuth, and arsenic), the time for traditional refining is greatly shortened (the traditional refining by oxidation for noble lead takes 4 days to 6 days per 10 tons of the noble lead, while the two-stage vacuum carbothermal reduction of the present disclosure totals 4 h to 12 h).

The recovered gold-rich residue contains almost no base metals such as lead, bismuth, antimony, and arsenic. After subjecting the recovered gold-rich residue to leaching gold by chlorination and reduction, a gold powder could be obtained with a lower content of base metals than traditional processes. Therefore, the method greatly reduces the amount of produced slag, and reduces the loss of precious metals in the slag.

The whole recovery method shortens a recovery cycle of precious metals, improves a direct yield of valuable metals, and has a closed system for the vacuum carbothermal reduction. The entire recovery method also avoids the emission of soot, improves the working environment and solves problems in arsenic recovery and emission, and has a simple and environmental-friendly process.

DETAILED DESCRIPTION OF THE EMBODIMENTS

Figure 1:
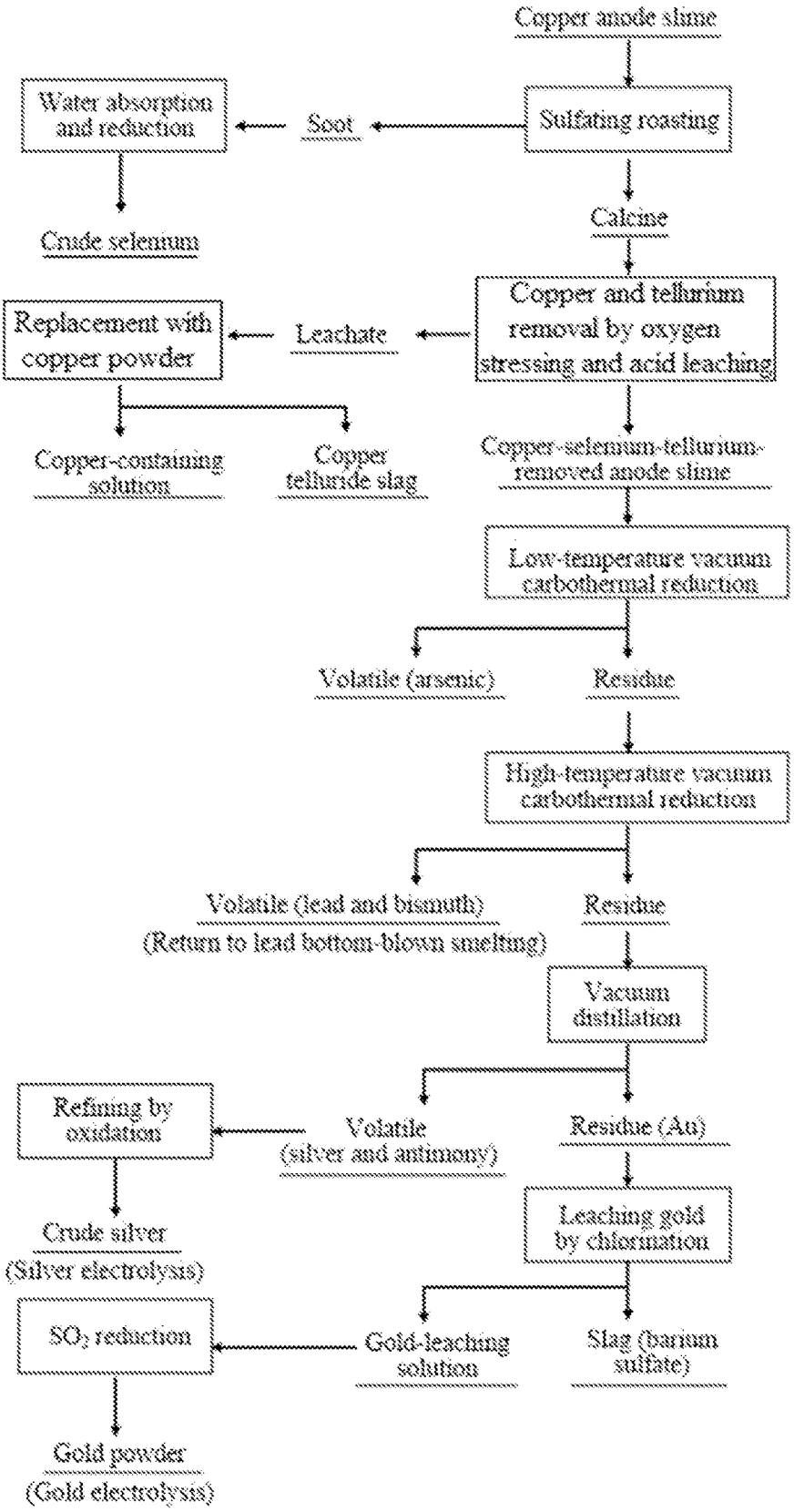
FIG. 1 shows a flowchart of the recovery method for valuable metals in copper anode slime according to embodiments of the present disclosure.

The present disclosure provides a recovery method for valuable metals in copper anode slime, including the following steps:

mixing copper anode slime with a concentrated sulfuric acid to obtain a first mixture, and subjecting the first mixture to sulfation roasting to obtain a selenium-containing soot and a calcine;

subjecting the selenium-containing soot to water absorption, first reduction, and drying in sequence to obtain a crude selenium;

mixing the calcine with a sulfuric acid solution to obtain a second mixture, and subjecting the second mixture to oxygen stressing and acid leaching to obtain a copper-tellurium-containing leachate and a copper-selenium-tellurium-removed anode slime;

mixing the copper-tellurium-containing leachate with a copper powder to obtain a third mixture, and subjecting the third mixture to second reduction to obtain a copper-tellurium slag and a copper sulfate solution;

mixing the copper-selenium-tellurium-removed anode slime with a first charcoal to obtain a fourth mixture, and subjecting the fourth mixture to low-temperature vacuum carbothermal reduction at 400° C. to 550° C. to obtain an arsenic oxide volatile and an arsenic-removed anode slime;

subjecting the arsenic-removed anode slime to high-temperature vacuum carbothermal reduction at 850° C. to 1,100° C. to obtain a lead-bismuth mixed volatile and a gold-silver-antimony-rich residue;

subjecting the gold-silver-antimony-rich residue to vacuum distillation to obtain a silver-antimony volatile and a gold-rich residue;

subjecting the silver-antimony volatile to refining by oxidation to obtain an antimony oxide volatile and a crude silver, and subjecting the crude silver to electrolysis to obtain silver; and subjecting the gold-rich residue to leaching gold by chlorination, third reduction, and electrolysis in sequence to obtain gold.

In the present disclosure, unless otherwise specified, the materials or reagents used all are commercially available products well known to those skilled in the art.

In the present disclosure, the copper anode slime is mixed with a concentrated sulfuric acid to obtain a first mixture, and the first mixture is subjected to sulfation roasting to obtain a selenium-containing soot and a calcine. There is no special limitation on a source and a composition of the copper anode slime, as long as the copper anode slime with corresponding components could be obtained from sources well known in the art. In examples of the present disclosure, the copper anode slime includes: 6.18% of Pb, 4.2% of Sb, 5.82% of As, 7.28% of Bi, 14.18% of Cu, 10.65% of Ag, 4.03% of Se, 1.02% of Te, 6.16% of Ni, 529.6 g/t of Au.

In some embodiments of the present disclosure, a mass ratio of the copper anode slime to the concentrated sulfuric acid is in a range of 1: (0.7-1.2), preferably 1:1; and the concentrated sulfuric acid has a mass concentration of 98%.

In some embodiments of the present disclosure, before mixing the copper anode slime with the concentrated sulfuric acid, large particle inclusions in the copper anode slime are removed by screening through conventional means. There is no special limitation on the process of mixing the copper anode slime and the concentrated sulfuric acid, and the mixing could be conducted according to the process well known in the art; in examples of the present disclosure, the mixing is specifically conducted in a stirring tank.

In some embodiments of the present disclosure, the sulfation roasting is conducted at 250° C. to 650° C., preferably 500° C. for 1 h to 4 h; and the sulfation roasting is conducted in a rotary kiln with a kiln head temperature of 250° C. to 300° C., a mid-kiln temperature of 500° C. to 600° C., and a kiln tail temperature of 550° C. to 650° C.

In some embodiments of the present disclosure, selenium is presented in the selenium-containing soot in the form of $SeO_2$.

In the present disclosure, the selenium-containing soot is subjected to water absorption, first reduction, and drying in sequence to obtain a crude selenium. There is no special limitation on the process of the water absorption, and the water absorption could be conducted according to the process well known in the art. During the sequential water absorption and first reduction of the selenium-containing soot, the $SeO_2$-containing soot is absorbed by water to form an $H_2SeO_3$ solution, and then reduced to elemental selenium by $SO_2$ gas in the soot. There is no special limitation on the process of the drying, and the drying could be conducted according to the process well known in the art. In some embodiments, the crude selenium has a purity of 85% to 99%.

In the present disclosure, the calcine is mixed with a sulfuric acid solution to obtain a second mixture, and the second mixture is subjected to oxygen stressing and acid leaching to obtain a copper-tellurium-containing leachate and a copper-selenium-tellurium-removed anode slime. In some embodiments, the sulfuric acid solution has an acidity of 100 g/L to 140 g/L, preferably 120 g/L to 130 g/L; and a dosage ratio of the sulfuric acid solution to the calcine is in a range of (5-8) L:1 kg, preferably (6-7) L:1 kg.

In some embodiments of the present disclosure, the oxygen stressing and acid leaching is conducted at 100° C. to 150° C., preferably 120° C. to 130° C.; the oxygen stressing and acid leaching is conducted at 0.8 MPa to 1.2 MPa, preferably 0.9 MPa to 1.0 MPa; and the oxygen stressing and acid leaching is conducted for 0.5 h to 4 h, preferably 0.5 h to 1 h. In the present disclosure, the oxygen stressing and acid leaching has a copper removal efficiency of greater than or equal to 98%.

In some embodiments of the present disclosure, after the oxygen stressing and acid leaching is completed, an obtained material is separated to obtain the copper-tellurium-containing leachate and the copper-selenium-tellurium-removed anode slime. There is no special limitation on the process of the separation, as long as solid-liquid separation could be conducted according to the well-known process in the art.

In the present disclosure, after obtaining the copper-tellurium-containing leachate, the copper-tellurium-containing leachate is mixed with a copper powder to obtain a third mixture, and the third mixture is subjected to second reduction to obtain a copper-tellurium slag and a copper sulfate solution. In the present disclosure, relative to the copper-tellurium-containing leachate, the copper powder is used in an excessive amount; in examples of the present disclosure, the amount of the copper powder relative to the copper-tellurium-containing leachate is specifically 80 g/L.

In the present disclosure, there is no special limitation on the process of mixing the copper-tellurium-containing leachate with the copper powder, and any process well known in the art that could mix the materials uniformly may be used. There is no special limitation on specific conditions for the reduction, and the reduction could be conducted according to procedures well known in the art. In some embodiments, after the second reduction is completed, an obtained product is filtered to obtain the copper-tellurium slag and the copper sulfate solution.

In the second reduction, the copper powder replaces copper-tellurium to form a copper telluride slag, in which tellurium and copper are separated in the form of compounds, and the separated copper sulfate solution is recycled for use.

In the present disclosure, after obtaining the copper-selenium-tellurium-removed anode slime, the copper-selenium-tellurium-removed anode slime is mixed with a first charcoal to obtain a fourth mixture, and the fourth mixture is subjected to low-temperature vacuum carbothermal reduction to obtain an arsenic oxide volatile and an arsenic-removed anode slime. In some embodiments, the mixing of the copper-selenium-tellurium-removed anode slime and the first charcoal includes adding a binder to obtain a fifth mixture, and pelletizing the fifth mixture to obtain a first spherical material, and then drying the first spherical material for the low-temperature vacuum carbothermal reduction. In some embodiments, the binder is starch, and there is no special limitation on the amount of the binder, which could be adjusted according to actual requirements. There is no special limitation on the process of the pelletizing, and the pelletizing may be conducted according to the process well known in the art. In some embodiments, the drying is conducted at 60° C. for 2 h and then at 160° C. for 2 h.

In some embodiments of the present disclosure, a mass of the first charcoal is 20% to 35%, preferably 25% to 30% of that of the copper-selenium-tellurium-removed anode slime; the low-temperature vacuum carbothermal reduction is conducted at 400° C. to 550° C., preferably 450° C. to 500° C., the low-temperature vacuum carbothermal reduction is conducted at a system pressure of 1 Pa to 50 Pa, preferably 10 Pa to 30 Pa; and the low-temperature vacuum carbothermal reduction is conducted for 2 h to 6 h, preferably 3 h to 4 h. In some embodiments, the low-temperature vacuum carbothermal reduction is conducted in a vacuum furnace, and there is no special limitation on the vacuum furnace, and vacuum furnaces well known in the art may be used.

After the low-temperature vacuum carbothermal reduction is completed, the arsenic oxide volatile is collected on a condensation hood, while obtaining the arsenic-removed anode slime.

In the present disclosure, after obtaining the arsenic-removed anode slime, the arsenic-removed anode slime is subjected to high-temperature vacuum carbothermal reduction to obtain a lead-bismuth mixed volatile and a gold-silver-antimony-rich residue. In some embodiments of the present disclosure, before conducting the high-temperature vacuum carbothermal reduction, the arsenic-removed anode slime is mixed with a second charcoal to obtain a sixth mixture, wherein a mass of the second charcoal is 0% to 10%, preferably 1% to 5% of that of the arsenic-removed anode slime. In some embodiments, the amount of the second charcoal is determined according to the remaining amount of the first charcoal used in the low-temperature vacuum carbothermal reduction; when the remaining amount of the first charcoal is enough to ensure that the high-temperature vacuum carbothermal reduction is completely conducted, no second charcoal is added; in some embodiments, after the low-temperature vacuum carbothermal reduction, the remaining amount of the first charcoal is detected by a method well known in the art, so as to determine the amount of the second charcoal added.

In some embodiments, the mixing of the arsenic-removed anode slime and the second charcoal further includes adding a binder to obtain a seventh mixture, pelletizing the seventh mixture to obtain a second spherical material, and then drying the second spherical material for high-temperature vacuum carbothermal reduction, wherein the type and amount of the binder, and the process of pelletizing and drying each are the same as those of the low-temperature vacuum carbothermal reduction, which are not repeated here.

In some embodiments of the present disclosure, the high-temperature vacuum carbothermal reduction is conducted at 850° C. to 1,100° C., preferably 900° C. to 1,000° C.; the high-temperature vacuum carbothermal reduction is conducted at a system pressure of 1 Pa to 50 Pa, preferably 10 Pa to 30 Pa; and the high-temperature vacuum carbothermal reduction is conducted for 2 h to 6 h, preferably 3 h to 5 h. In some embodiments, the high-temperature vacuum carbothermal reduction is conducted in a vacuum furnace. After the high-temperature vacuum carbothermal reduction is completed, lead and bismuth in the arsenic-removed anode slime volatilize in the form of compounds or simple substances (such as lead oxide, lead sulfide, and lead, bismuth, and antimony) and enter the volatiles to be recovered in a condensation pan, which could return to a lead bottom-blown smelting system for recovery. Lead and bismuth are reduced to crude metals, and silver is supplemented by lead and enters the crude metals to ensure a removal efficiency of lead and bismuth while avoiding the loss of silver. The residue is rich in precious metals of gold, silver, and antimony, and further includes barium. There is no special limitation on the recovery process of the lead bottom-blown smelting system, which could be conducted according to the process well known in the art.

In the present disclosure, after obtaining the gold-silver-antimony-rich residue, the gold-silver-antimony-rich residue is subjected to vacuum distillation to obtain a silver-antimony volatile and a gold-rich residue. In some embodiments, the vacuum distillation is conducted at 1,300° C. to 1,500° C., preferably 1,400° C. to 1,500° C.; the vacuum distillation is conducted at a system pressure of 1 Pa to 50 Pa, preferably 1 Pa to 10 Pa; and the vacuum distillation is conducted for 6 h to 8 h, preferably 6.5 h to 7.5 h.

During the distillation, silver and antimony in the gold-silver-antimony-rich residue volatilizes into the volatiles, and most of the gold is enriched in the residue, thus obtaining the silver-antimony volatile and the gold-rich residue. There is no special limitation on the process of recovering the silver-antimony volatile, and the volatile could be recovered according to the process well known in the art.

In the present disclosure, after obtaining the silver-antimony volatile, the silver-antimony volatile is subjected to refining by oxidation to obtain an antimony oxide volatile and a crude silver, and the crude silver is subjected to electrolysis to obtain silver. In some embodiments, the refining by oxidation is conducted at 950° C. to 1,100° C., preferably 1,000° C. to 1,050° C.; and the refining by oxidation is conducted for 3 h to 10 h, preferably 5 h to 8 h. During the refining by oxidation, antimony in the silver-antimony volatile volatilizes into the volatiles in a form of antimony oxide while obtaining the crude silver. There is no special limitation on the process of recovering the antimony oxide volatile and the process of electrolysis on the crude silver, which could be conducted according to processes well known in the art.

In the present disclosure, after obtaining the gold-rich residue, the gold-rich residue is subjected to leaching gold by chlorination, third reduction, and electrolysis in sequence to obtain gold. In some embodiments, subjecting the gold-rich residue to leaching gold by chlorination, third reduction, and electrolysis in sequence includes: subjecting the gold-rich residue to the leaching gold by chlorination to obtain a gold-leaching solution; introducing sulfur dioxide into the gold-leaching solution to conduct the third reduction to obtain a gold powder; and subjecting the gold powder to the electrolysis to obtain the gold. There are no special limitations on reagents and the specific process of the leaching gold by chlorination, which could be conducted according to the process well known in the art; there are no special limitations on the amount of sulfur dioxide introduced, the specific process of the reduction, and the process of electrolysis on the gold powder, which could be conducted according to the process well known in the art.

In some embodiments of the present disclosure, gold leaching slag obtained from the leaching gold by chlorination is used for recovering barium sulfate; there is no special limitation on the process of recovering the barium sulfate, which could be conducted according to processes well known in the art.

FIG. 1 shows a flowchart of the recovery method for valuable metals in copper anode slime in the present disclosure. As shown in FIG. 1, in the present disclosure, the copper anode slime is subjected to sulfation roasting to obtain a selenium-containing soot (flue gas) and a calcine; the selenium-containing soot is subjected to water absorption and reduction to obtain a crude selenium; the calcine is subjected to oxygen stressing and acid leaching to obtain a copper-tellurium-containing leachate and a copper-selenium-tellurium-removed anode slime; the copper-tellurium-containing leachate is subjected to replacement and reduction with a copper powder to obtain a copper-tellurium slag (a copper telluride slag) and a copper sulfate solution (a copper-containing solution); the copper-selenium-tellurium-removed anode slime is subjected to low-temperature vacuum carbothermal reduction to obtain an arsenic oxide volatile and an arsenic-removed anode slime (a residue); the arsenic-removed anode slime is subjected to high-temperature vacuum carbothermal reduction to obtain a lead-bismuth mixed volatile and a gold-silver-antimony-rich residue; the gold-silver-antimony-rich residue is subjected to vacuum distillation to obtain a silver-antimony volatile and a gold-rich residue; the silver-antimony volatile is subjected to refining by oxidation to obtain an antimony oxide volatile and a crude silver, and the crude silver is subjected to electrolysis to obtain silver; the gold-rich residue is subjected to leaching gold by chlorination to obtain a gold-leaching solution, the gold-leaching solution is subjected to $SO_2$ reduction to obtain a gold powder, and the gold powder is subjected to electrolysis to obtain gold; and gold-leaching slag obtained from the leaching gold by chlorination is used to recover barium sulfate.

The technical solutions of the present disclosure will be described below clearly and completely in conjunction with the examples of the present disclosure. Apparently, the described examples are only a part of, not all of, the examples of the present disclosure. All other embodiments obtained by those of ordinary skill in the art based on the embodiments of the present disclosure without creative efforts shall fall within the protection scope of the present disclosure.

Example 1

2,500 kg of copper anode slime (mainly consisting of: 6.18% of Pb, 4.2% of Sb, 5.82% of As, 7.28% of Bi, 14.18% of Cu, 10.65% of Ag, 4.03% of Se, 1.02% of Te, 6.16% of Ni, and 529.5 g/t of Au) was screened to remove large particle inclusions, and then slurried with a concentrated sulfuric acid (98%) in a stirring tank at a mass ratio of 1:1; the slurried anode slime was sent to a rotary kiln with a kiln head temperature of 300° C., a mid-kiln temperature of 500° C., and a kiln tail temperature of 600° C., and subjected to sulfation roasting at 500° C. for 4 h to obtain an $SeO_2$-containing soot and a calcine; the $SeO_2$-containing soot was subjected to water absorption to obtain an $H_2SeO_3$ solution, and the solution was reduced to elemental selenium by $SO_2$ gas in the soot, and a crude selenium (with a purity of 89%) was obtained after drying.

The calcine was immersed in a dilute sulfuric acid (with an acidity of 100 g/L), subjected to oxygen stressing and acid leaching (at 120° C. and 0.8 MPa for 30 min with a liquid-solid ratio of 5 L:1 kg), and separated to obtain a copper-tellurium-containing leachate and a copper-selenium-tellurium-removed anode slime (mainly consisting of: 12.11% of Pb, 4.85% of Sb, 9.35% of As, 12.92% of Bi, 0.05% of Cu, 11.65% of Ag, 0.71% of Se, 1.46% of Te, 0.41% of Ni, and 936.5 g/t of Au).

The copper-tellurium-containing leachate was added with an excess copper powder at a ratio of 80 g/L, subjected to reduction, and then filtered to obtain a copper-tellurium slag and a copper sulfate solution.

100.00 g of the copper-selenium-tellurium-removed anode slime (mainly consisting of: 12.11% of Pb, 4.85% of Sb, 9.35% of As, 12.92% of Bi, 0.05% of Cu, 11.65% of Ag, 0.71% of Se, 1.46% of Te, 0.41% of Ni, and 936.5 g/t of Au) was mixed with 30 g of charcoal, and then mixed with 3 g of a starch binder, and the resulting mixture was subjected to pelletizing to obtain a first spherical material; the first spherical material was dried at 60° C. for 2 h and then at 160° C. for 2 h, and then subjected to low-temperature carbothermal reduction in a vacuum furnace at 550° C. and a system pressure of 1 Pa to 10 Pa for 4 h; and an arsenic oxide volatile was collected on a condensation hood, while obtaining 82.92 g of a residue (an arsenic-removed anode slime), wherein arsenic was reduced from 9.35% in the raw materials to 0.48%, such that 95.82% of arsenic was removed.

The arsenic-removed anode slime was mixed with 3 g of a starch binder, and then subjected to pelletizing to obtain a second spherical material; the second spherical material was dried at 60° C. for 2 h and then at 160° C. for 2 h, and then subjected to high-temperature carbothermal reduction in a vacuum furnace at 1,100° C. and a system pressure of 1 Pa to 10 Pa for 2 h; a lead-bismuth mixed volatile was collected on a condensing pan, while obtaining a gold-silver-antimony-rich residue.

The gold-silver-antimony-rich residue was subjected to vacuum distillation at 1,400° C. for 6 h to obtain a silver-antimony volatile and a gold-rich residue.

The silver-antimony volatile was subjected to refining by oxidation at 1,000° C. for 3 h to obtain an antimony oxide volatile and a crude silver, and the crude silver was subjected to electrolysis, obtaining silver.

The gold-rich residue was subjected to leaching gold by chlorination, third reduction, and electrolysis in sequence, obtaining gold.

Composition and content detection were conducted on the lead-bismuth mixed volatile and the gold-silver-antimony-rich residue. For the residue, lead and bismuth were reduced from 12.11% and 12.92% in the raw materials to 0.77% and 0.039%, showing removal efficiencies reaching 97.12% and 99.87%, respectively; for the copper anode slime, 2.5% of silver entered the volatile, and gold was not detected in the volatile.

Characterization and Test

Figure 2:
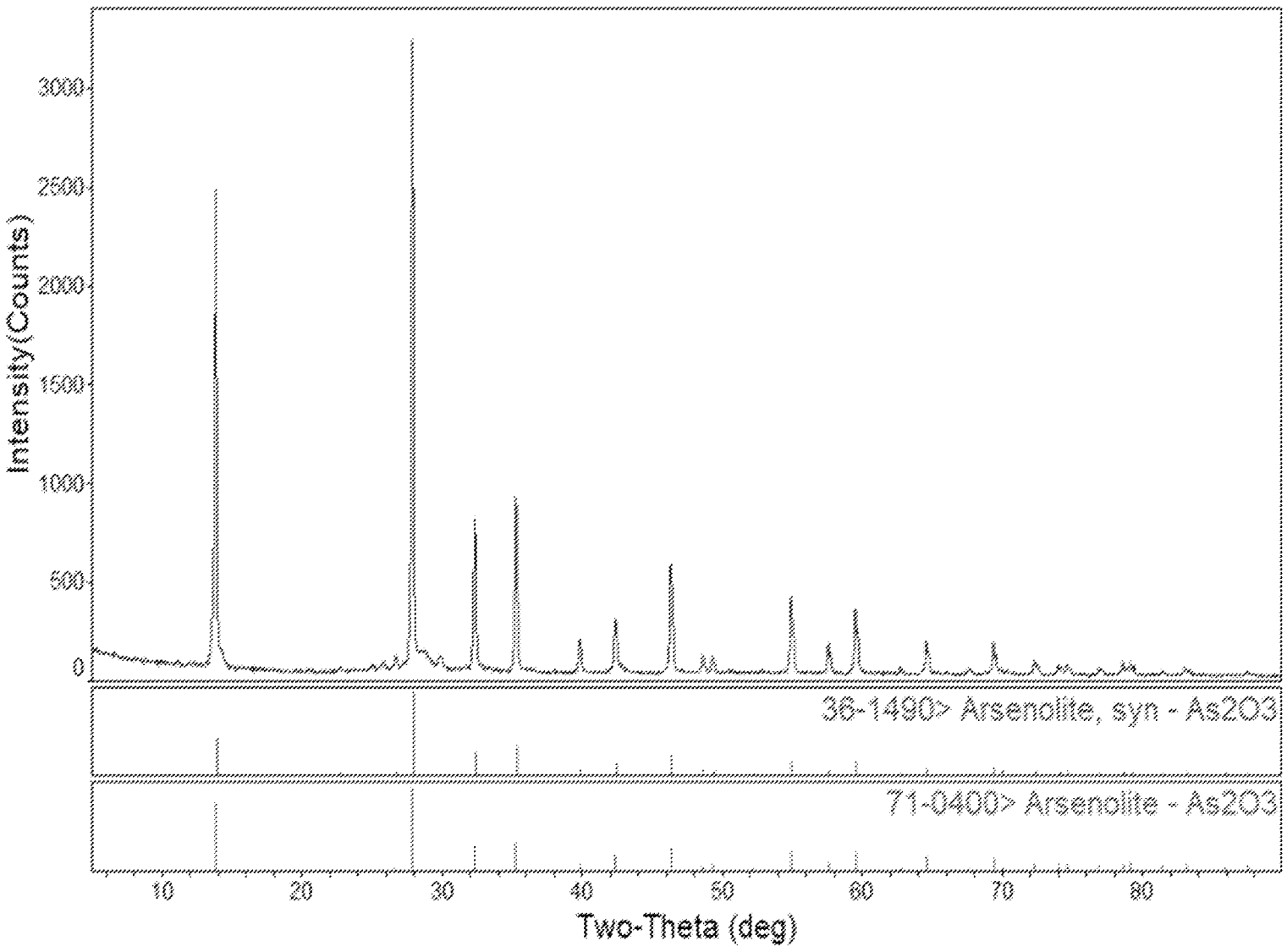
FIG. 2 shows an X-ray diffraction (XRD) pattern of an arsenic oxide volatile obtained after the low-temperature carbothermal reduction in Example 1.
Figure 3:
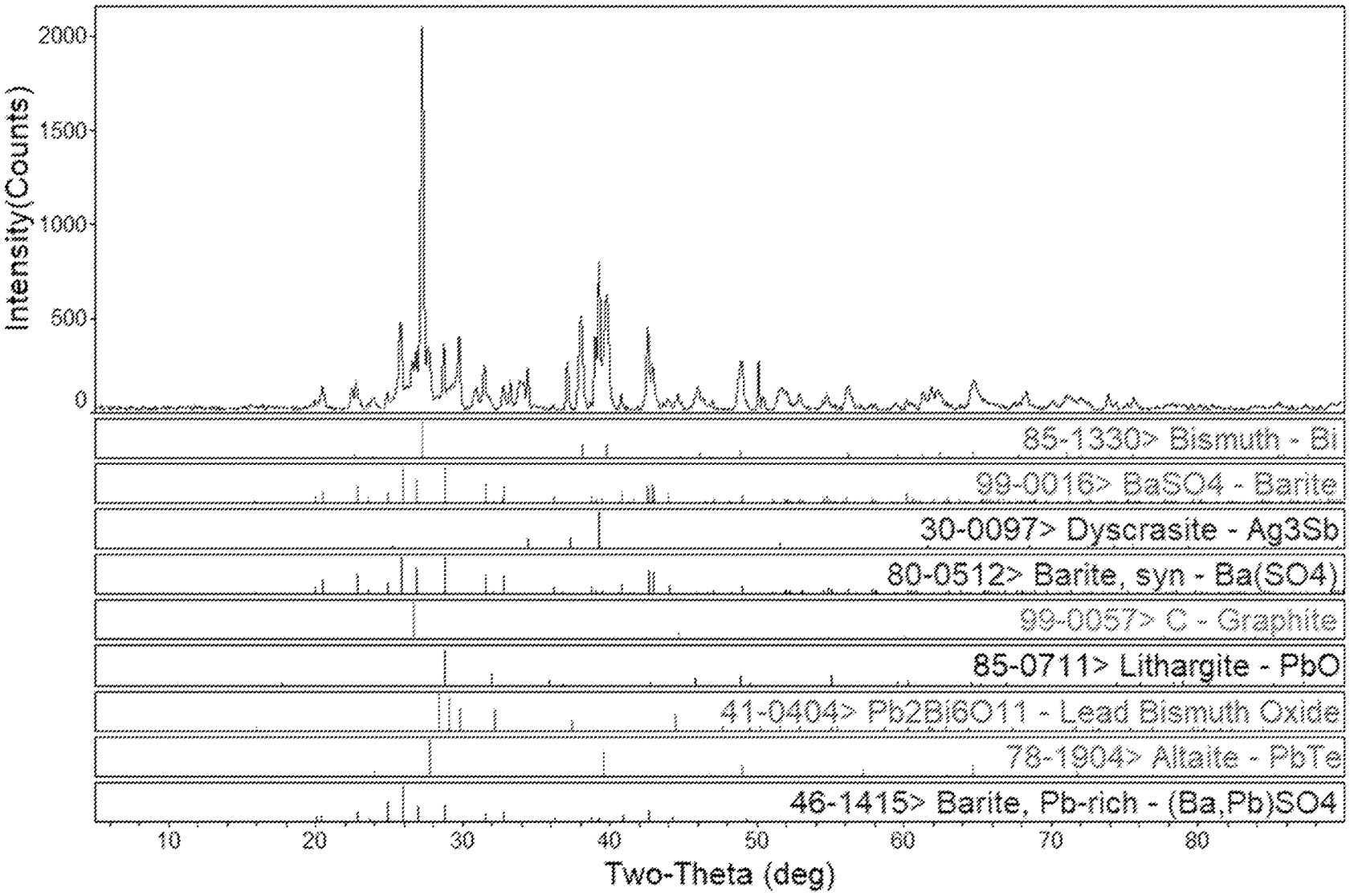
FIG. 3 shows an XRD pattern of a residue obtained after the low-temperature carbothermal reduction in Example 1.

1) An XRD test was conducted on the arsenic oxide volatile and the residue (arsenic-removed anode slime) obtained after low-temperature carbothermal reduction in Example 1. The results are shown in FIG. 2 and FIG. 3, wherein FIG. 2 is an XRD pattern of the arsenic oxide volatile, and FIG. 3 is an XRD pattern of the residue. It can be seen from FIG. 2 to FIG. 3 that the volatile is arsenic oxide with a single phase, and lead and bismuth in the residue have not been completely removed.

Figure 4:
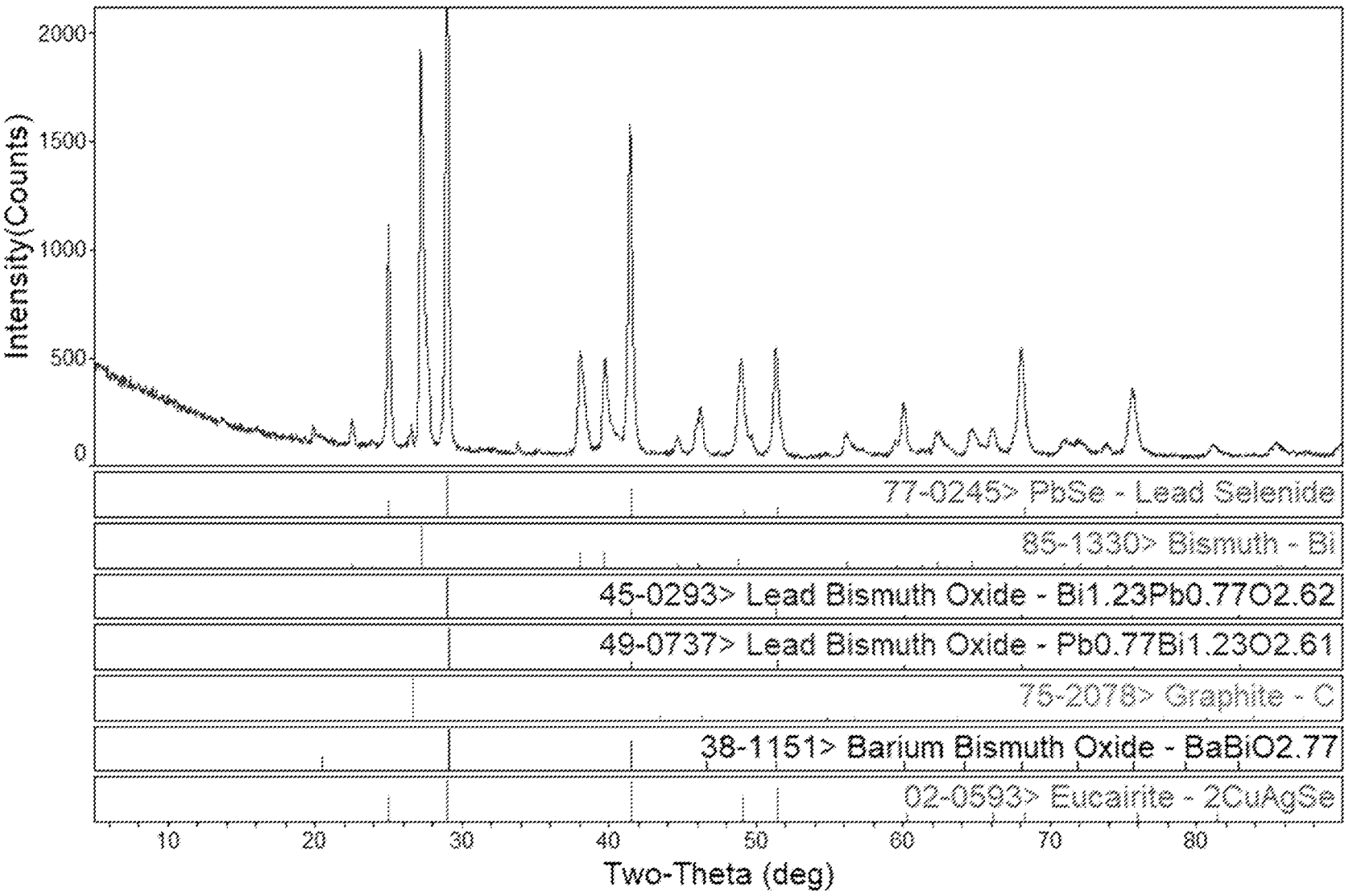
FIG. 4 shows an XRD pattern of a lead-bismuth mixed volatile obtained after the high-temperature carbothermal reduction in Example 1.
Figure 5:
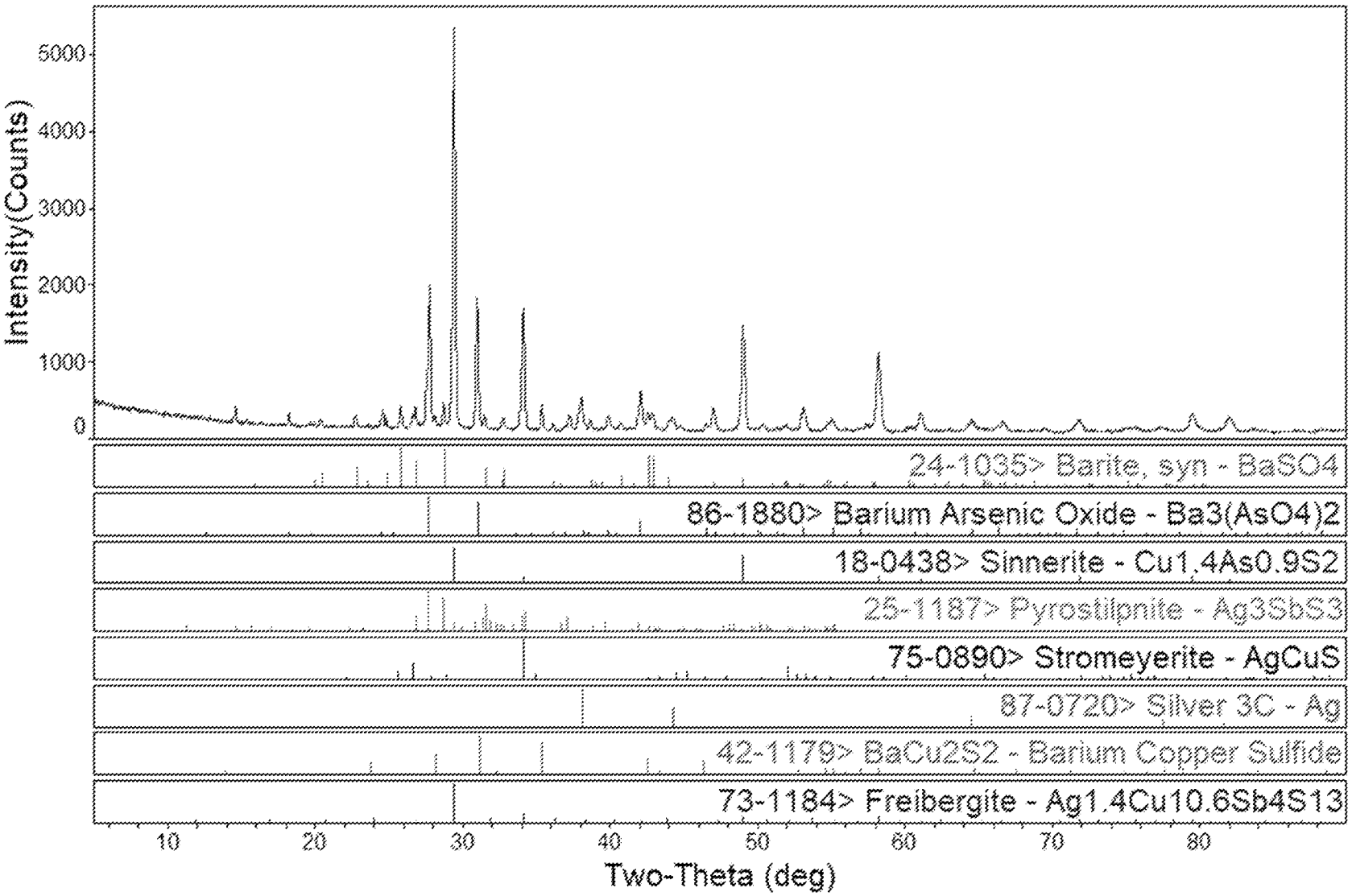
FIG. 5 shows an XRD pattern of a gold-silver-antimony-rich residue obtained after the high-temperature carbothermal reduction in Example 1.

2) An XRD test was conducted on the lead-bismuth mixed volatile and the gold-silver-antimony-rich residue obtained after high-temperature carbothermal reduction in Example 1. The results are shown in FIG. 4 and FIG. 5, wherein FIG. 4 is an XRD pattern of the volatile, and FIG. 5 is an XRD pattern of the gold-silver-antimony-rich residue. From FIG. 4 to FIG. 5, it can be seen that there was no phases of lead and bismuth in the residue, indicating that lead, bismuth, and arsenic are completely removed after two stages of carbothermal reduction. The existence form of precious metals in the residue was mainly silver-antimony compounds, and the amount of charcoal added was excessive, providing theoretical support for the extraction of silver-antimony by vacuum distillation in the later stage.

3) The element content in the vacuum carbothermal reduction in Example 1 was detected, and the results are shown in Table 1.

TABLE 1

Element balance of vacuum carbothermal reduction in Example 1 (/g)

| Item | | As | Pb | Bi | Ag | Au |
|---|---|---|---|---|---|---|
| | Raw material | 9.35 | 12.11 | 12.92 | 11.65 | 0.09365 |
| Low-temperature vacuum carbothermal reduction | Volatile | 8.96 | | | —* | — |
| | Residue | 0.39 | 12.05 | 12.85 | 11.65 | 0.9365* |
| High-temperature vacuum carbothermal reduction | Volatile | — | 11.59 | 12.89 | 0.29 | — |
| | Residue | 0.32 | 0.35 | 0.02 | 11.25 | 0.9365* |
| Metal direct yield in vacuum carbothermal reduction stages/% | | 99.25 | 98.57 | 98.95 | 99.06 | 100 |

Notes:
*means undetected, — means not detected.

It can be seen from Table 1 that there is almost no loss of precious metals in the whole carbothermal reduction processes (including low-temperature carbothermal reduction and high-temperature carbothermal reduction). The loss of silver shown in Table 1 is mainly due to analysis errors, and in particular, the experiment is conducted in a small scale, and some products may remain in the equipment during the distillation, causing errors. It can also be seen from Table 1 that there are extremely low contents of lead and bismuth in the residue after two carbothermal reductions, which greatly reduced the difficulty and processing capacity of the subsequent precious metal purification. Meanwhile, more than 96% of arsenic removal and nearly 99% direct recovery of arsenic were achieved.

Example 2

2,500 kg of copper anode slime (mainly consisting of: 6.18% of Pb, 4.2% of Sb, 5.82% of As, 7.28% of Bi, 14.18% of Cu, 10.65% of Ag, 4.03% of Se, 1.02% of Te, 6.16% of Ni, and 529.5 g/t of Au) was sieved to remove large particle inclusions, and slurried with a concentrated sulfuric acid (98%) in a stirring tank at a mass ratio of 1:1; the slurried anode slime was sent to a rotary kiln with a kiln head temperature of 300° C., a mid-kiln temperature of 500° C., and a kiln tail temperature of 600° C., and then subjected to sulfation roasting at 500° C. for 4 h to obtain an $SeO_2$-containing soot and a calcine; the $SeO_2$-containing soot was subjected to water absorption to obtain an $H_2SeO_3$ solution, and the solution was reduced to elemental selenium by $SO_2$ gas in the soot, and a crude selenium (with a purity of 90%) was obtained after drying.

The calcine was immersed in a dilute sulfuric acid (with an acidity of 100 g/L), subjected to oxygen stressing and acid leaching (at 120° C. and 0.8 MPa for 30 min with a liquid-solid ratio of 5 L:1 kg), and separated to obtain a copper-tellurium-containing leachate and a copper-selenium-tellurium-removed anode slime (consisting of: 12.11% of Pb, 4.85% of Sb, 9.35% of As, 12.92% of Bi, 0.05% of Cu, 11.65% of Ag, 0.71% of Se, 1.46% of Te, 0.41% of Ni, and 936.5 g/t of Au).

The copper-tellurium-containing leachate was added with an excess copper powder at a ratio of 80 g/L, subjected to reduction, and filtered to obtain a copper-tellurium slag and a copper sulfate solution.

1005.6 g of the copper-selenium-tellurium-removed anode slime (consisting of: 12.11% of Pb, 4.85% of Sb, 9.35% of As, 12.92% of Bi, 0.05% of Cu, 11.65% of Ag, 0.71% of Se, 1.46% of Te, 0.41% of Ni, and 936.5 g/t of Au) was mixed with 300 g of charcoal, and then mixed with 30 g of a starch binder, and the resulting mixture was subjected to pelletizing to obtain a first spherical material; the first spherical material was dried at 60° C. for 2 h and then at 160° C. for 2 h, and then subjected to low-temperature carbothermal reduction in a vacuum furnace at 550° C. and a system pressure of 1 Pa to 10 Pa for 2 h; and an arsenic oxide volatile was collected on a condensation hood (arsenic oxide with a single phase, containing 63.42% arsenic), while obtaining 810 g of a residue (arsenic-removed anode slime), wherein arsenic was reduced from 9.35% in the raw materials to 0.32%, such that 97.49% of arsenic was removed.

The arsenic-removed anode slime was mixed with 30 g of a starch binder, and subjected to pelletizing to obtain a second spherical material; the spherical material was dried at 60° C. for 2 h and then at 160° C. for 2 h, and then subjected to high-temperature carbothermal reduction in a vacuum furnace at 1,100° C. and a system pressure of 1 Pa to 10 Pa for 4 h; a lead-bismuth mixed volatile was collected on a condensing pan, while obtaining a gold-silver-antimony-rich residue.

The gold-silver-antimony-rich residue was subjected to vacuum distillation at 1,400° C. for 6 h to obtain a silver-antimony volatile and a gold-rich residue.

The silver-antimony volatile was subjected to refining by oxidation at 1,000° C. for 3 h to obtain an antimony oxide volatile and a crude silver, and the crude silver was subjected to electrolysis, obtaining silver.

The gold-rich residue was subjected to leaching gold by chlorination, third reduction, and electrolysis in sequence, obtaining gold.

Composition and content detection were conducted on the lead-bismuth mixed volatile and the gold-silver-antimony-rich residue. For the residue, lead and bismuth were reduced from 12.11% and 12.92% in the raw materials to 0.47% and 0.029%, showing removal efficiencies reaching 98.12% and 99.89%, respectively; for the copper anode slime, 3.1% of silver entered the volatile, and gold was not detected in the volatile.

Characterization and Test

Figure 6A:
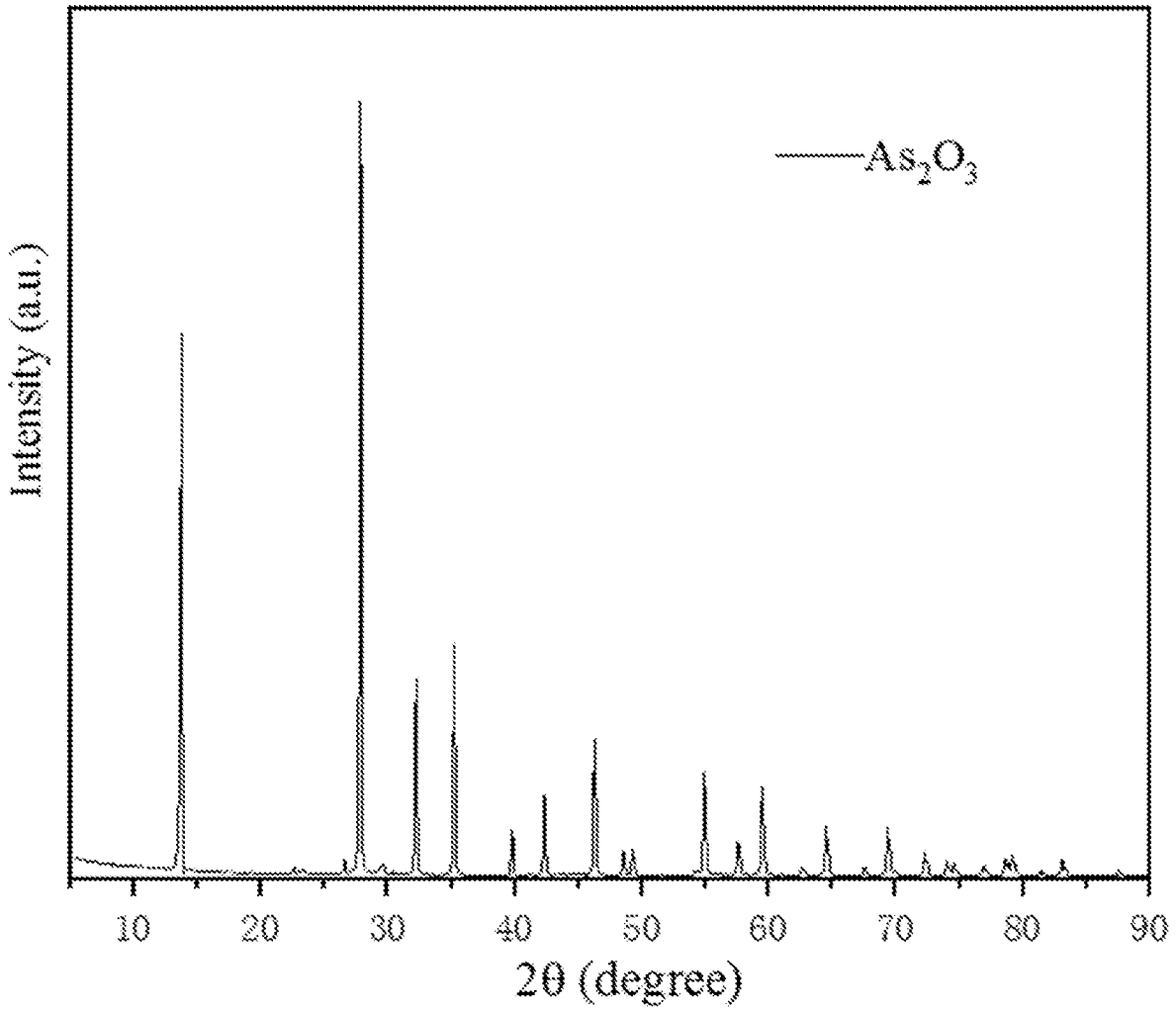
FIG. 6A shows an XRD pattern of an arsenic oxide volatile obtained after the low-temperature carbothermal reduction in Example 2.
Figure 6B:
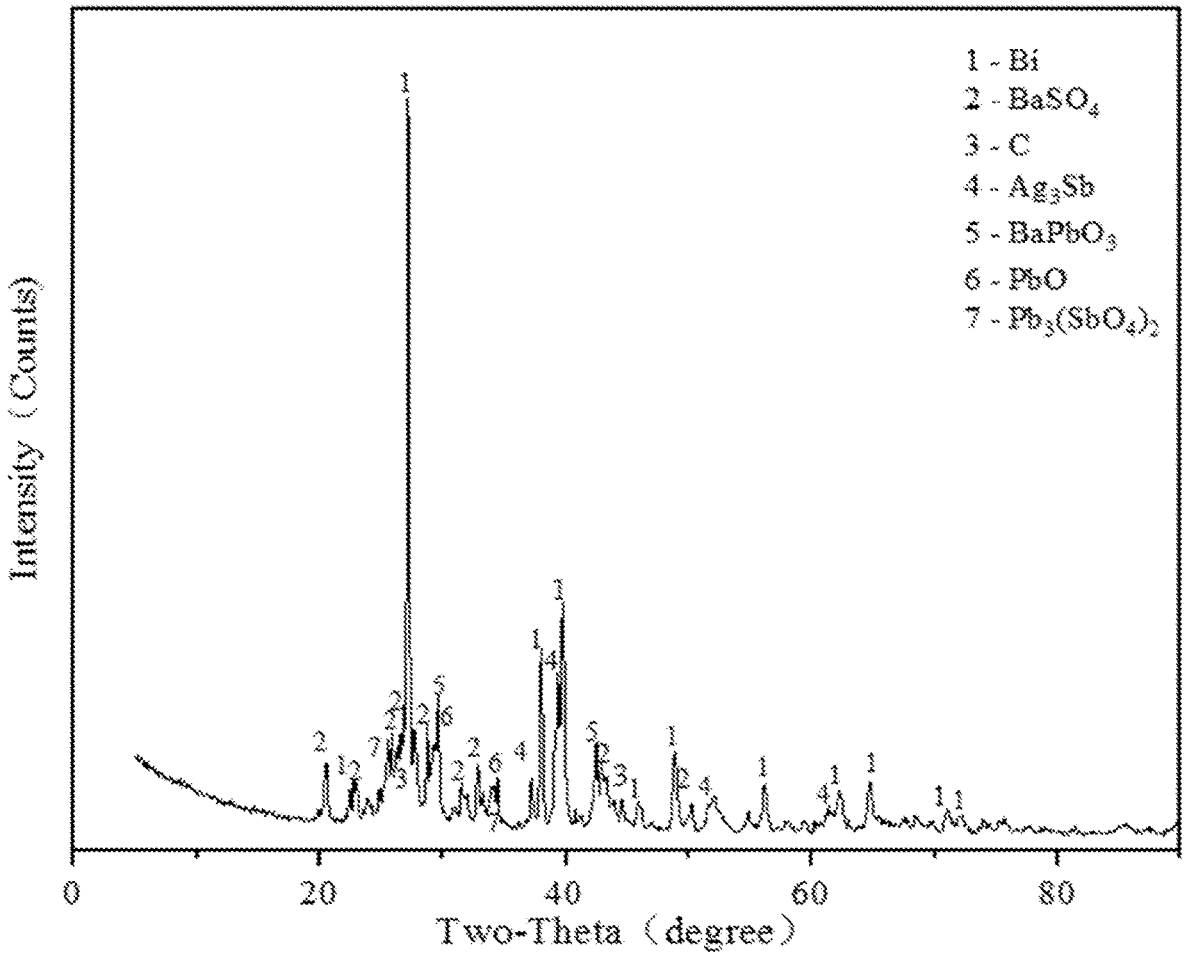
FIG. 6B shows an XRD pattern of a residue obtained after the low-temperature carbothermal reduction in Example 2.

1) An XRD test was conducted on the arsenic oxide volatile and the residue (arsenic-removed anode slime) obtained after low-temperature carbothermal reduction in Example 2. The results are shown in FIGS. 6A-6B, wherein FIG. 6A is an XRD pattern of the arsenic oxide volatile, and FIG. 6B is an XRD pattern of the residue. It can be seen from FIGS. 6A-6B that the volatile was arsenic oxide with a single phase, and lead and bismuth in the residue had not been removed.

Figure 7A:
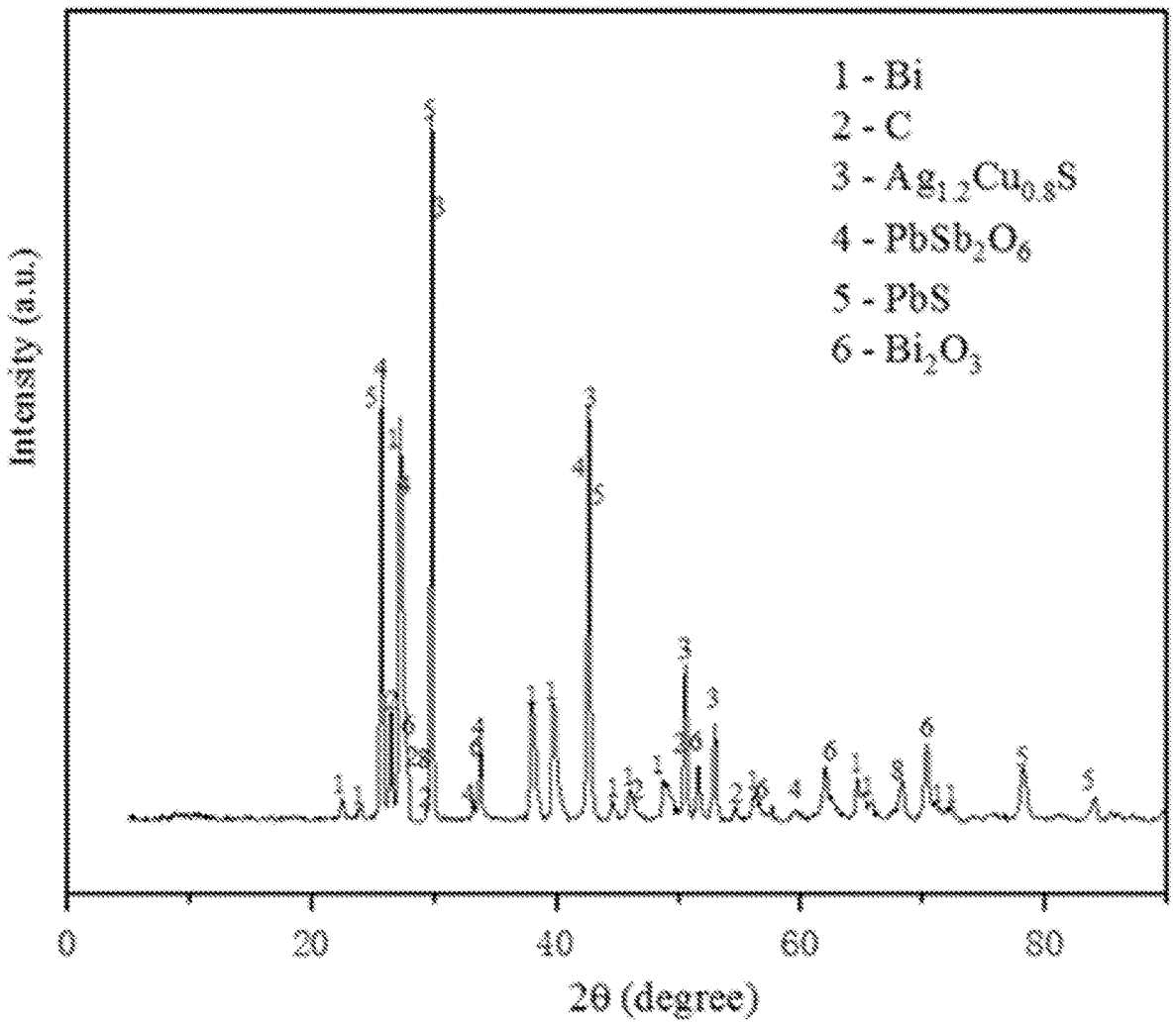
FIG. 7A shows an XRD pattern of a lead-bismuth mixed volatile obtained after the high-temperature carbothermal reduction in Example 2.
Figure 7B:
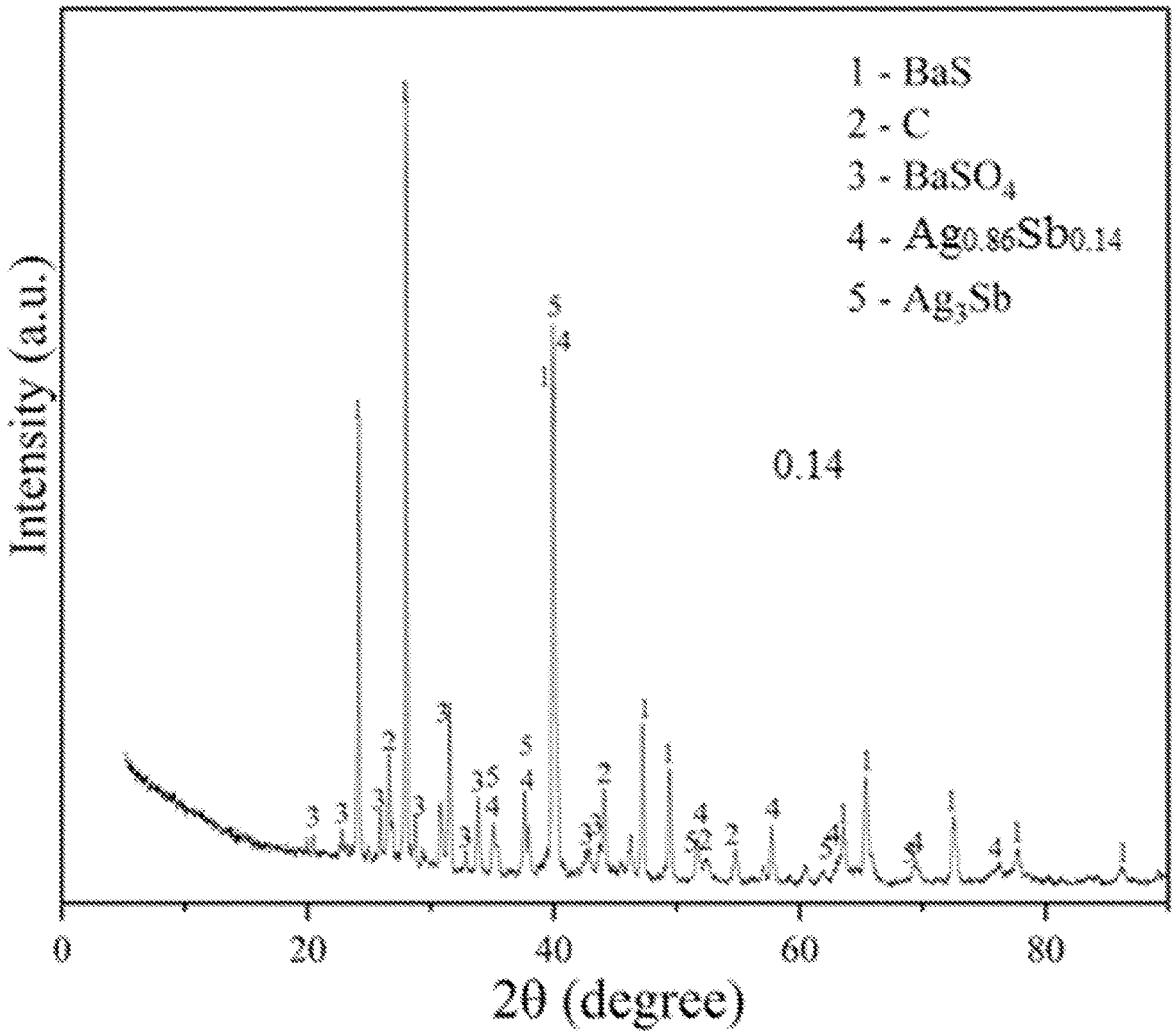
FIG. 7B shows an XRD pattern of a gold-silver-antimony-rich residue obtained after the high-temperature carbothermal reduction in Example 2.

2) The XRD test was conducted on the lead-bismuth mixed volatile and the gold-silver-antimony-rich residue obtained after high-temperature carbothermal reduction in Example 2. The results are shown in FIGS. 7A-7B, wherein FIG. 7A is an XRD pattern of the volatile, and FIG. 7B is an XRD pattern of the residue. From FIGS. 7A-7B, it can be seen that there are no phases of lead and bismuth in the residue, indicating that lead, bismuth, and arsenic are completely removed after two stages of carbothermal reduction. The existence form of precious metals in the residue was mainly silver-antimony compounds, providing theoretical support for the extraction of silver-antimony by vacuum distillation in the later stage.

3) The element content in the vacuum carbothermal reduction in Example 2 was detected, and the results are shown in Table 2.

TABLE 2

Element balance of vacuum carbothermal reduction in Example 2 (/g)

| Item | | As | Pb | Bi | Ag | Au |
|---|---|---|---|---|---|---|
| | Raw material | 93.5 | 121.1 | 129.2 | 116.5 | 0.9365 |
| Low-temperature vacuum carbothermal reduction | Volatile | 89.9 | | | —* | — |
| | Residue | 2.6 | 121.1 | 129.2 | 116.5 | 0.9365* |
| High-temperature vacuum carbothermal reduction | Volatile | — | 118.6 | 129 | 3.5 | — |
| | Residue | 0.32 | 1.55 | 0.01 | 112.89 | 0.9365* |
| Metal direct yield in vacuum carbothermal reduction stages/% | | 99.27 | 99.22 | 99.92 | 99.91 | 100 |

Notes:
*means undetected, — means not detected.

It can be seen from Table 2 that gold is not detected in the volatile during the stages of low-temperature vacuum carbothermal reduction and high-temperature vacuum carbothermal reduction, indicating that all gold elements are enriched in the residue obtained from high-temperature vacuum carbothermal reduction.

The above descriptions are merely preferred embodiments of the present disclosure. It should be noted that a person of ordinary skill in the art may further make several improvements and modifications without departing from the principle of the present disclosure, but such improvements and modifications should be deemed as falling within the protection scope of the present disclosure.

What is claimed is:

1. A recovery method for valuable metals in copper anode slime, comprising the following steps:

mixing copper anode slime with a concentrated sulfuric acid to obtain a first mixture, and subjecting the first mixture to sulfation roasting to obtain a selenium-containing soot and a calcine;

subjecting the selenium-containing soot to water absorption, first reduction, and drying in sequence to obtain a crude selenium;

mixing the calcine with a sulfuric acid solution to obtain a second mixture, and subjecting the second mixture to oxygen stressing and acid leaching to obtain a copper-tellurium-containing leachate and a copper-selenium-tellurium-removed anode slime;

mixing the copper-tellurium-containing leachate with a copper powder to obtain a third mixture, and subjecting the third mixture to second reduction to obtain a copper-tellurium slag and a copper sulfate solution;

mixing the copper-selenium-tellurium-removed anode slime with a first charcoal to obtain a fourth mixture, and subjecting the fourth mixture to low-temperature vacuum carbothermal reduction at 400° C. to 550° C. to obtain an arsenic oxide volatile and an arsenic-removed anode slime;

subjecting the arsenic-removed anode slime to high-temperature vacuum carbothermal reduction at 850° C. to 1,100° C. to obtain a lead-bismuth mixed volatile and a gold-silver-antimony-rich residue;

subjecting the gold-silver-antimony-rich residue to vacuum distillation to obtain a silver-antimony volatile and a gold-rich residue;

subjecting the silver-antimony volatile to refining by oxidation to obtain an antimony oxide volatile and a crude silver, and subjecting the crude silver to electrolysis to obtain silver; and subjecting the gold-rich residue to leaching gold by chlorination, third reduction, and electrolysis in sequence to obtain gold.

2. The recovery method of claim 1, wherein a mass ratio of the copper anode slime to the concentrated sulfuric acid is in a range of 1:(0.7-1.2); the concentrated sulfuric acid has a mass concentration of 98%; and the sulfation roasting is conducted at 250° C. to 650° C. for 1 h to 4 h.

3. The recovery method of claim 2, wherein the mass ratio of the copper anode slime to the concentrated sulfuric acid is 1:1.

4. The recovery method of claim 1, wherein the sulfation roasting is conducted in a rotary kiln with a kiln head temperature of 250° C. to 300° C., a mid-kiln temperature of 500° C. to 600° C., and a kiln tail temperature of 550° C. to 650° C.

5. The recovery method of claim 1, wherein the crude selenium has a purity of 85% to 99%.

6. The recovery method of claim 1, wherein during the oxygen stressing and acid leaching, the sulfuric acid solution has an acidity of 100 g/L to 140 g/L; a dosage ratio of the sulfuric acid solution to the calcine is in a range of (5-8) L:1 kg; and the oxygen stressing and acid leaching is conducted at 100° C. to 150° C. and 0.8 MPa to 1.2 MPa for 0.5 h to 4 h.

7. The recovery method of claim 1, wherein the oxygen stressing and acid leaching has a copper removal efficiency of greater than or equal to 98%.

8. The recovery method of claim 6, wherein the sulfuric acid solution has an acidity of 120 g/L to 130 g/L; and the dosage ratio of the sulfuric acid solution to the calcine is in a range of (6-7) L:1 kg.

9. The recovery method of claim 6, wherein the oxygen stressing and acid leaching is conducted at 120° C. to 130° C. and 0.9 MPa to 1.0 MPa for 0.5 h to 1 h.

10. The recovery method of claim 1, wherein during the low-temperature vacuum carbothermal reduction, a mass of the first charcoal is 20% to 35% of that of the copper-selenium-tellurium-removed anode slime; and the low-temperature vacuum carbothermal reduction is conducted at a system pressure of 1 Pa to 50 Pa for 2 h to 6 h.

11. The recovery method of claim 10, wherein the mass of the first charcoal is 25% to 30% of that of the copper-selenium-tellurium-removed anode slime; and the low-temperature vacuum carbothermal reduction is conducted at 450° C. to 500° C. and the system pressure of 10 Pa to 30 Pa for 3 h to 4 h.

12. The recovery method of claim 1, wherein before the high-temperature vacuum carbothermal reduction, the arsenic-removed anode slime is mixed with a second charcoal; a mass of the second charcoal is 0% to 10% of that of the arsenic-removed anode slime; and the high-temperature vacuum carbothermal reduction is conducted at a system pressure of 1 Pa to 50 Pa for 2 h to 6 h.

13. The recovery method of claim 12, wherein the mass of the second charcoal is 1% to 5% of that of the arsenic-removed anode slime.

14. The recovery method of claim 1, wherein the high-temperature vacuum carbothermal reduction is conducted at 900° C. to 1,000° C. and a system pressure of 10 Pa to 30 Pa for 3 h to 5 h.

15. The recovery method of claim 1, wherein the vacuum distillation is conducted at 1,300° C. to 1,500° C. and a system pressure of 1 Pa to 50 Pa for 6 h to 8 h.

16. The recovery method of claim 15, wherein the vacuum distillation is conducted at 1,400° C. to 1,500° C. and a system pressure of 1 Pa to 10 Pa for 6.5 h to 7.5 h.

17. The recovery method of claim 1, wherein the refining by oxidation is conducted at 950° C. to 1,100° C. for 3 h to 10 h.

18. The recovery method of claim 17, wherein the refining by oxidation is conducted at 1,000° C. to 1,050° C. for 5 h to 8 h.

19. The recovery method of claim 1, wherein subjecting the gold-rich residue to leaching gold by chlorination, third reduction, and electrolysis in sequence comprises: subjecting the gold-rich residue to the leaching gold by chlorination to obtain a gold-leaching solution; introducing sulfur dioxide into the gold-leaching solution to conduct the third reduction to obtain a gold powder; and subjecting the gold powder to the electrolysis.

20. The recovery method of claim 2, wherein the sulfation roasting is conducted in a rotary kiln with a kiln head temperature of 250° C. to 300° C., a mid-kiln temperature of 500° C. to 600° C., and a kiln tail temperature of 550° C. to 650° C.

* * * * *